US009022379B2

(12) United States Patent
Takahashi et al.

(10) Patent No.: US 9,022,379 B2
(45) Date of Patent: May 5, 2015

(54) PAPER FEEDING DEVICE AND IMAGE FORMING APPARATUS

(71) Applicants: Hideaki Takahashi, Kanagawa (JP); Tatsuya Sugawara, Kanagawa (JP); Taewon Kim, Kanagawa (JP); Shinji Katsumata, Kanagawa (JP); Isamu Funayama, Kanagawa (JP)

(72) Inventors: Hideaki Takahashi, Kanagawa (JP); Tatsuya Sugawara, Kanagawa (JP); Taewon Kim, Kanagawa (JP); Shinji Katsumata, Kanagawa (JP); Isamu Funayama, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/273,722

(22) Filed: May 9, 2014

(65) Prior Publication Data

US 2014/0339759 A1 Nov. 20, 2014

(30) Foreign Application Priority Data

May 16, 2013 (JP) ..... 2013-104285

(51) Int. Cl.

| | |
|---|---|
| ***B65H 3/56*** | (2006.01) |
| ***B65H 3/12*** | (2006.01) |
| ***B65H 3/48*** | (2006.01) |
| ***B65H 1/02*** | (2006.01) |
| ***B65H 9/00*** | (2006.01) |
| ***B65H 3/08*** | (2006.01) |
| ***B65H 5/00*** | (2006.01) |
| ***B65H 7/02*** | (2006.01) |
| ***B65H 1/18*** | (2006.01) |

(52) U.S. Cl.

CPC ..... *B65H 1/025* (2013.01); *B65H 9/00* (2013.01); *B65H 3/08* (2013.01); *B65H 5/00* (2013.01); *B65H 7/02* (2013.01); *B65H 3/128* (2013.01); *B65H 1/18* (2013.01); *B65H 3/56* (2013.01); *B65H 3/48* (2013.01)

(58) Field of Classification Search

CPC ..... B65H 3/56; B65H 3/48; B65H 1/18; B65H 3/128

USPC ..... 271/104, 11, 31, 167, 97, 98

See application file for complete search history.

(56) References Cited

U.S. PATENT DOCUMENTS

| | | | | |
|---|---|---|---|---|
| 4,235,432 | A * | 11/1980 | Marschke | 271/11 |
| 7,506,868 | B2 * | 3/2009 | Oota et al. | 271/124 |
| 7,600,748 | B2 * | 10/2009 | Takai et al. | 271/106 |
| 7,677,550 | B2 * | 3/2010 | Okazaki | 271/11 |
| 8,814,159 | B2 * | 8/2014 | Kadowaki | 271/94 |

FOREIGN PATENT DOCUMENTS

| | | |
|---|---|---|
| JP | 07-101575 | 4/1995 |
| JP | 2011-057379 | 3/2011 |

* cited by examiner

*Primary Examiner* — Luis A Gonzalez

(74) *Attorney, Agent, or Firm* — Harness, Dickey & Pierce, P.L.C.

(57) ABSTRACT

In the present invention, when a status of clogging a paper due to some cause occurs, controls of inverting a conveyance roller and returning the jammed paper in a paper feeding tray is performed. At this time, the position of a paper damming up member is lowered by an actuator when the jammed paper is returned to the paper feeding tray and the conveyance roller is inverted so as to avoid a state in which the paper damming up member 33 hinders the returning of the paper and the paper cannot be returned to the paper feeding tray. The paper damming up member is lowered to a position that is lower than a conveyance guide plate at a downstream side in a paper conveying direction. Then, the paper is returned to the paper feeding tray without damage. The returned paper can be reused.

6 Claims, 9 Drawing Sheets

PAPER FEEDING DEVICE AND IMAGE FORMING APPARATUS

CROSS-REFERENCE TO RELATED APPLICATIONS

The present application claims priority to and incorporates by reference the entire contents of Japanese Patent Application No. 2013-104285 filed in Japan on May 16, 2013.

BACKGROUND OF THE INVENTION

1. Field of the Invention

The present invention relates to an image forming apparatus such as a copying machine, a printer, or a multifunctional peripheral, and a paper feeding device provided therein.

2. Description of the Related Art

There is a paper feeding device provided in an image forming apparatus, which sucks an uppermost paper of a plurality of papers stacked in a tray by a suction belt, and feeds the paper to an image forming unit. Among this type of paper feeding devices, one that feeds papers to the image forming unit of the image forming apparatus one by one at a high speed is known. An outline thereof is illustrated in FIG. 1.

In the paper feeding device of FIG. 1, a current of air is blown from an air blowing unit (a nozzle, or the like, and hereinafter, described as blower) 1 against an front end surface and side end surfaces of a paper bundle P, which is a plurality of papers stacked in a tray. This current of air sends air between the papers that make the paper bundle P. Accordingly, an uppermost paper P1 of the paper bundle P (hereinafter, referred to as uppermost paper) is floated to the height of a suction belt 2, and the uppermost paper P1 is sucked by the suction belt 2. Then, the sucked uppermost paper P1 is conveyed by the suction belt 2 to the image forming unit, and image formation is performed to the uppermost paper P1 in the image forming unit.

The blower 1 also handles the papers by blowing on a region in a predetermined height direction, and sending the air between the papers to float the papers. A paper damming up member 7 is arranged between the blower 1 and the paper bundle P, and prevents the papers other than the uppermost paper P1 from being conveyed. Further, a detection unit 3 that comes in contact with an upper surface of the uppermost paper P1 and detects the height of the paper bundle P is provided. The detection unit 3 detects data for constantly maintaining a distance h between the position of the uppermost paper P1 of the paper bundle P that is decreased due to passing of the papers and the suction belt 2. To realize that, an actuator 4 and a sensor 5 that detects swinging of the actuator 4, such as a photo sensor, are included. The actuator 4 swings due to a decrease of the papers, and the sensor 5 detects a moving amount of the swinging. A bottom plate 6 of a paper feeding tray 21 is lifted by a lift unit (not illustrated) or the like based on a detection signal thereof, and the position of the uppermost paper P1 of the paper bundle P is adjusted.

The papers that make the paper bundle P are stacked on the bottom plate 6 such that the front end surfaces are arranged as reference surfaces in accordance with the size of the papers, as illustrated in FIG. 1. A mounting position of the actuator 4 is a vicinity of a rear end of the paper bundle P, which is less subjected to an effect of the air blowing of the blower 1, as illustrated in FIG. 1. A conveyance roller 8 is arranged at a downstream side of the suction belt 2 in a paper conveying direction, and conveys the papers that have arrived. The conveying force of the conveyance roller 8 is set larger than the conveying force of the suction belt 2. Further, a paper feeding sensor 9 that detects arrival of a paper is provided at a downstream side of the conveyance roller 8 in the paper conveying direction.

Next, a paper feeding operation of the conventional paper feeding device illustrated in FIG. 1 will be described step by step.

(1) The blower 1 is actuated when a paper feeding instruction comes from a main body (not illustrated) of the image forming apparatus, and air blowing of the blower 1 to an end portion of the paper bundle P is started, as illustrated in FIG. 2. At the same time, air suction of the suction belt 2 is started. Accordingly, the uppermost paper P1 is floated, and the uppermost paper P1 is sucked to the suction belt, as illustrated in FIG. 2.

(2) Driving of the suction belt 2 and the conveyance roller 8 are started, and the paper P1 is conveyed (FIG. 3).

(3) The driving of the suction belt 2 is stopped after arrival of the paper P1 to the paper feeding sensor 9 (FIG. 4). The conveyance roller 8 continues conveyance of the paper P1 in a state where the suction belt 2 is being stopped.

(4) A paper P2 directly under the uppermost paper P1 is floated and sucked immediately after the paper P1 passes through a suction region (FIG. 5).

(5) The driving of the suction belt 2 is restarted, and the paper feeding of the paper P2 is performed, according to a set paper feeding interval.

(6) Hereinafter, the papers are sequentially conveyed from the paper bundle P by repetition of (2) to (5).

Next, behavior of the front end surface of the paper bundle P by air blowing will be described. Note that, in FIGS. 7(A) to 11(B), the arrow V in each drawing (B) illustrates each drawing (A) as viewed in a direction of the arrow V.

FIG. 6 is a detailed diagram of the blower 1. The air blowing unit 1 is divided into a floating nozzle 31 and a separating nozzle 32, and these nozzles have different functions. When air blowing is performed through the floating nozzle 31, air (31) blows into an upper portion of the paper P as illustrated in FIGS. 7(A) and 7(B), and floating and separation of the papers are performed at the same time. Among the floated papers, the uppermost paper is sucked by the suction belt 2, and is prepared for conveyance. Next, blowing through the separating nozzle 32 is performed from the state of FIGS. 7(A) and 7(B). The air blowing through the separating nozzle 32 is an air flow having a volume in an up and down direction. Therefore, the air blowing into a central portion of the papers is pressed in a downward direction except for the uppermost paper (FIGS. 8(A) and 8(B)). Accordingly, the papers are divided into the uppermost paper P1, and second and subsequent papers, and only the uppermost paper P1 sucked to the suction belt 2 is conveyed.

By the way, such a paper feeding device is required to perform paper feeding of a wide range of papers from a thin paper to a thick paper. In a paper feeding mechanism using the above air separation and suction, paper feeding of a thin paper may sometimes be difficult. When air blowing through the floating nozzle 31 is performed to thin papers set in the tray in the paper feeding mechanism using air separation and suction, floating of the papers can be easily performed because the papers are light. Accordingly, the second and subsequent papers are strongly pressed down to the suction belt 2, and the papers are closely adhered to the uppermost paper (FIGS. 9(A) and 9(B)). When the blowing through the separating nozzle 32 is performed in that state, the uppermost paper and the second paper are separated by the separation air in the central portion of the papers. However, the uppermost paper and the second paper other than the central portion remain to be closely adhered. When the paper feeding is performed in this state, the uppermost paper P1 and the second and subsequent papers are not completely separated, and thus, two papers may be conveyed while being stacked together. That is, double feeding occurs.

Therefore, there is a paper feeding device in which the paper damming up member 7 is arranged at a front surface of the paper feeding tray 21 (a surface of a downstream side in the paper conveying direction) in order to prevent the papers under the uppermost paper P1 from being drawn by the uppermost paper P1 and being fed (FIGS. 1, and 10(A) and 10(B)). The paper damming up member 7 is provided directly under the suction belt 2, and thus a clearance of about 1 to 3 mm is taken between the paper damming up member 7 and the suction belt 2 in order to prevent breakage of the suction belt 2. Therefore, the paper damming up member 7 is provided at a portion pressed by the separating nozzle 32 in a downward direction (in front of the separating nozzle), and exerts an effect to dam up only a pressed-down paper.

However, when the paper damming up member 7 is arranged in front of the separating nozzle 32, the flow of the air through the separating nozzle 32 is impeded (FIGS. 11(A) and 11(B)). Therefore, the pressing down effect by the separating nozzle 32 is decreased, and the papers under the uppermost paper P1 are slipped over the paper damming up member 7 and are fed. This causes occurrence of the double feeding. The occurrence of the double feeding causes wasteful consumption of the papers and inclusion of white papers in an output product, and significantly reduces the quality as a device.

In view of the above-described problems, there is a need to provide a paper feeding device capable of performing stable paper feeding and returning of a jammed paper to a paper feeding tray even in a paper feeding system using air separation and suction.

SUMMARY OF THE INVENTION

It is an object of the present invention to at least partially solve the problems in the conventional technology.

According to the present invention, there is provided a paper feeding device comprising: a suction unit configured to suck an uppermost paper positioned at an uppermost position from among a paper bundle stacked on a paper feeding tray by air suction, and to convey the sucked paper; a paper damming up member configured to dam up a paper other than the uppermost paper from being conveyed from the paper feeding tray; a guide unit positioned at a downstream side of a conveyance start position of the uppermost paper by the suction unit in a paper conveying direction, and configured to serve as a guide when the uppermost paper conveyed by the suction unit is further conveyed toward the downstream side in the paper conveying direction; an uppermost paper surface position detection unit configured to detect a height position of the uppermost paper in an up and down direction; and a control unit configured to lift/lower the paper feeding tray such that a height position of the uppermost paper in the tray becomes a predetermined position by a lift unit based on the position of the uppermost paper detected by the uppermost paper surface position detection unit, wherein a height position of the paper damming up member is variable in a height direction of the paper bundle loaded in the paper feeding tray, at least a rear end portion of the guide unit in the paper conveying direction is arranged at an upper portion than an upper end of the paper damming up member, and the control unit variably controls the height position of the paper damming up member according to a result of detection by the uppermost paper surface position detection unit, and controls the paper damming up member to lower when a paper conveyed from the paper feeding tray is clogged and is once returned to the paper feeding tray.

The present invention also provides an image forming apparatus comprising a paper feeding device for feeding a paper to an image forming unit, wherein the paper feeding device comprises: a suction unit configured to suck an uppermost paper positioned at an uppermost position from among a paper bundle stacked on a paper feeding tray by air suction, and to convey the sucked paper; a paper damming up member configured to dam up a paper other than the uppermost paper from being conveyed from the paper feeding tray; a guide unit positioned at a downstream side of a conveyance start position of the uppermost paper by the suction unit in a paper conveying direction, and configured to serve as a guide when the uppermost paper conveyed by the suction unit is further conveyed toward the downstream side in the paper conveying direction; an uppermost paper surface position detection unit configured to detect a height position of the uppermost paper in an up and down direction; and a control unit configured to lift/lower the paper feeding tray such that a height position of the uppermost paper in the tray becomes a predetermined position by a lift unit based on the position of the uppermost paper detected by the uppermost paper surface position detection unit, wherein a height position of the paper damming up member is variable in a height direction of the paper bundle loaded in the paper feeding tray, at least a rear end portion of the guide unit in the paper conveying direction is arranged at an upper portion than an upper end of the paper damming up member, and the control unit variably controls the height position of the paper damming up member according to a result of detection by the uppermost paper surface position detection unit, and controls the paper damming up member to lower when a paper conveyed from the paper feeding tray is clogged and is once returned to the paper feeding tray.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the present invention will be described with reference to the drawings.

Figure 1:
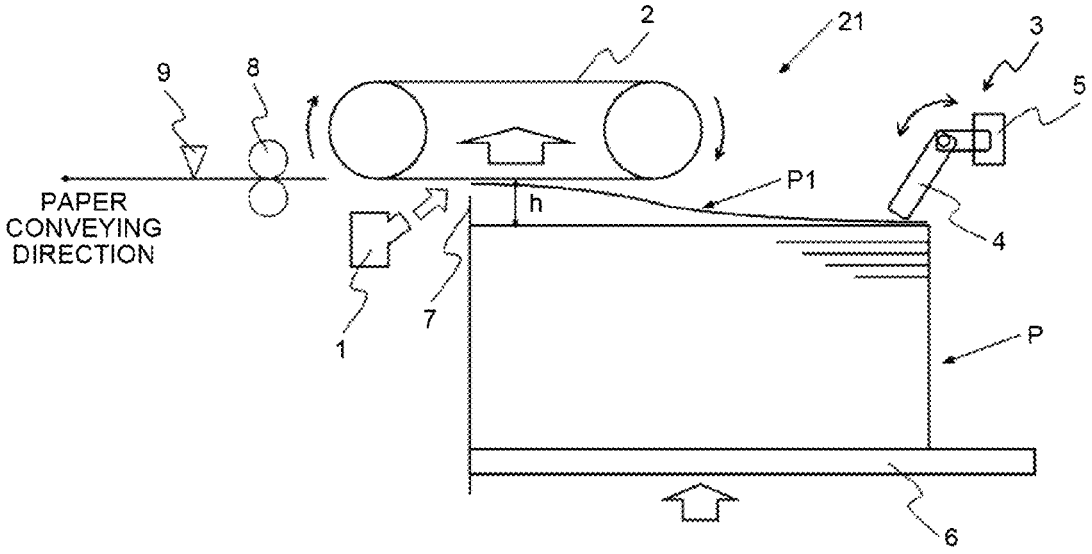
FIG. 1 is a diagram illustrating a conventional example of a paper feeding device that sucks an uppermost paper by a suction belt and feeds the paper to an image forming unit.
Figure 2:
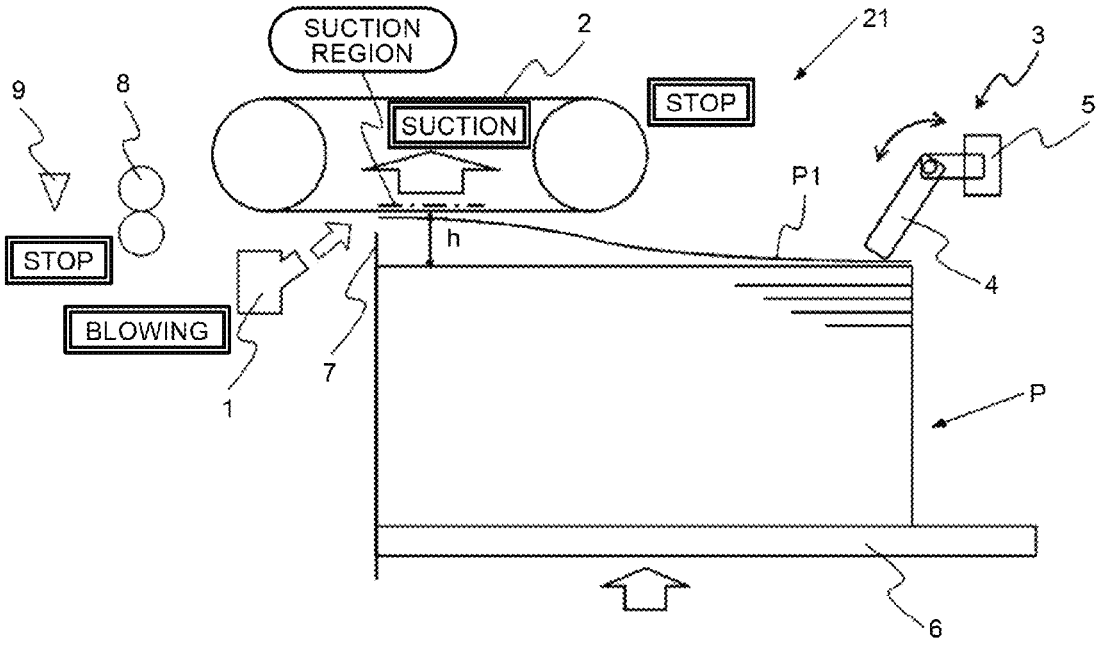
FIG. 2 is a diagram illustrating a state in which a paper is sucked in the device of FIG. 1.
Figure 3:
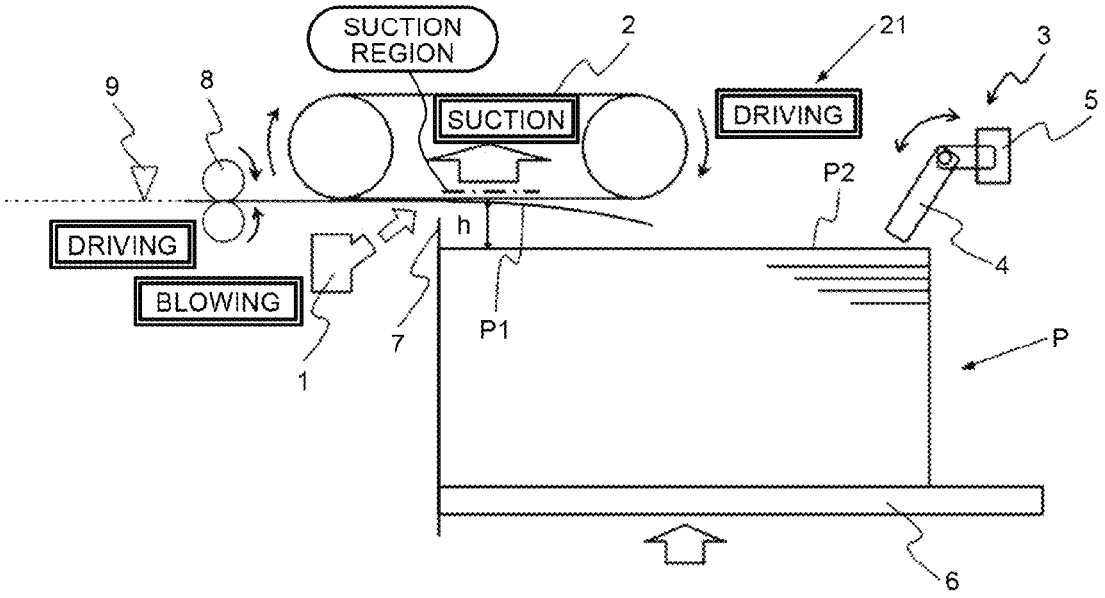
FIG. 3 is a diagram illustrating a state in which the sucked paper is conveyed in the device of FIG. 1.
Figure 4:
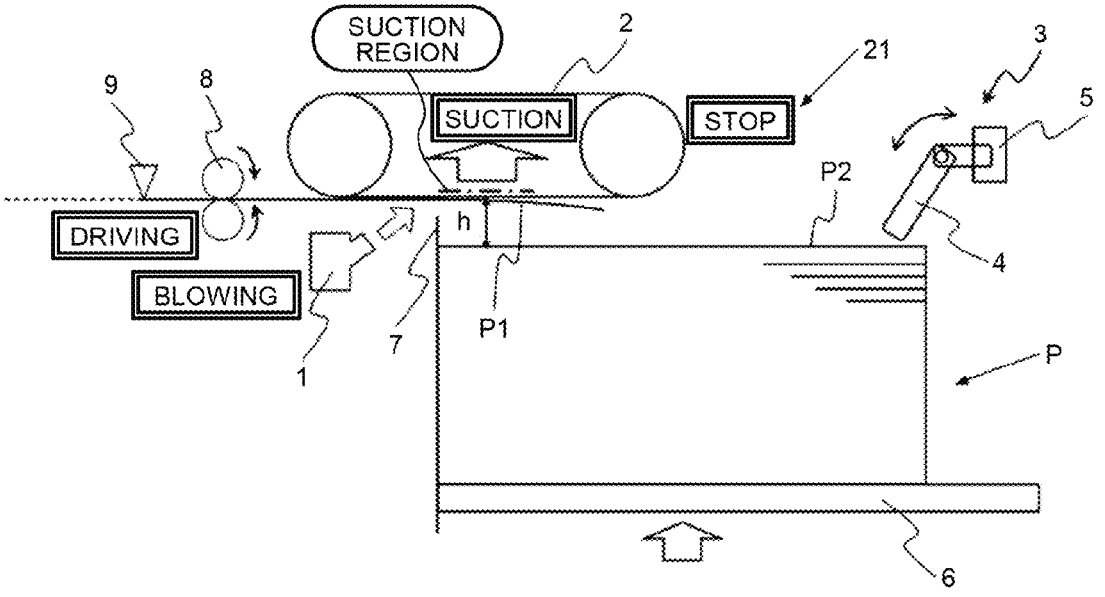
FIG. 4 is a diagram illustrating a state in which the conveyance of the sucked paper by the suction belt is stopped, and the paper is conveyed by a conveyance roller in the device of FIG. 1.
Figure 5:
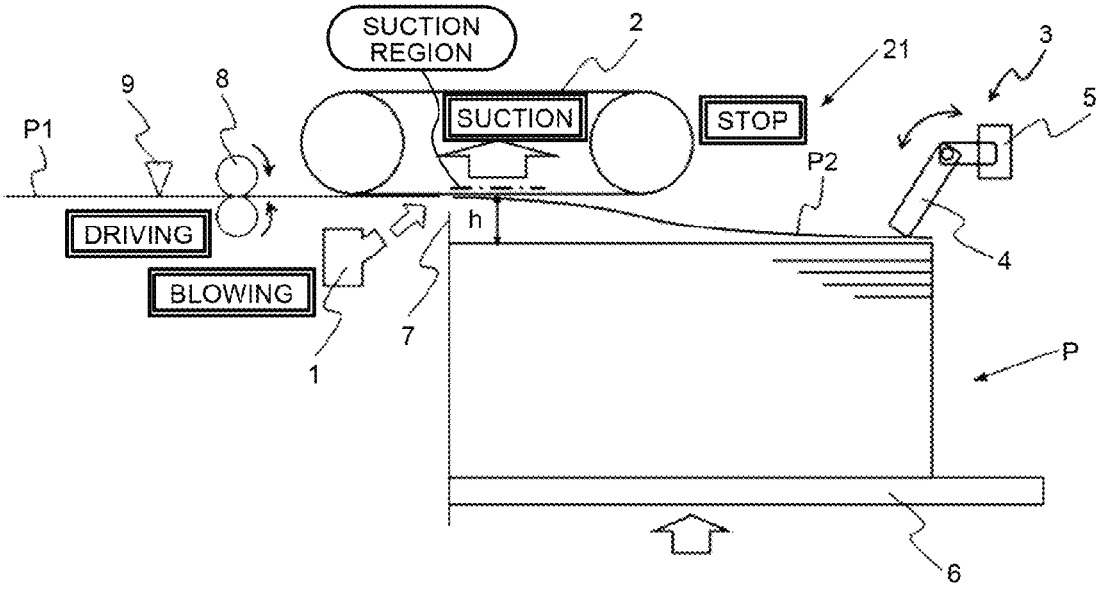
FIG. 5 is a diagram illustrating a state in which the conveyance is more advanced than FIG. 4.
Figure 6:
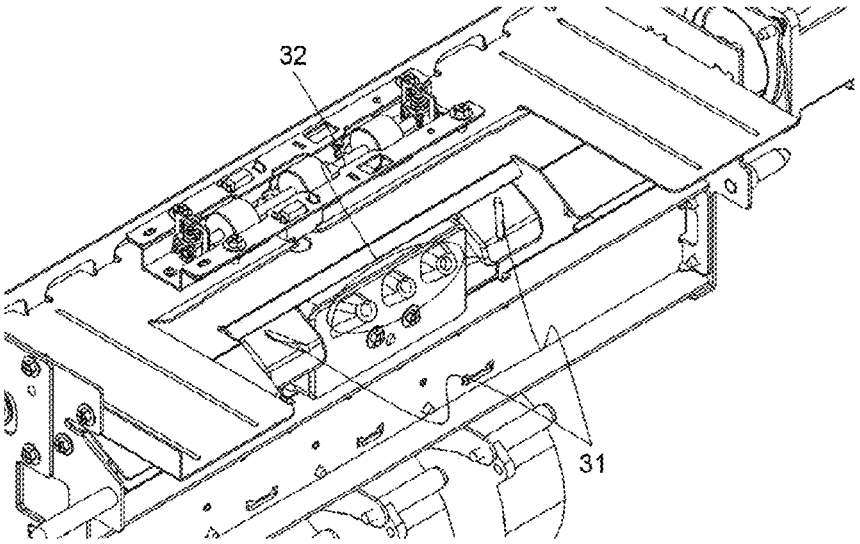
FIG. 6 is a detailed diagram of a blower.
Figure 7:
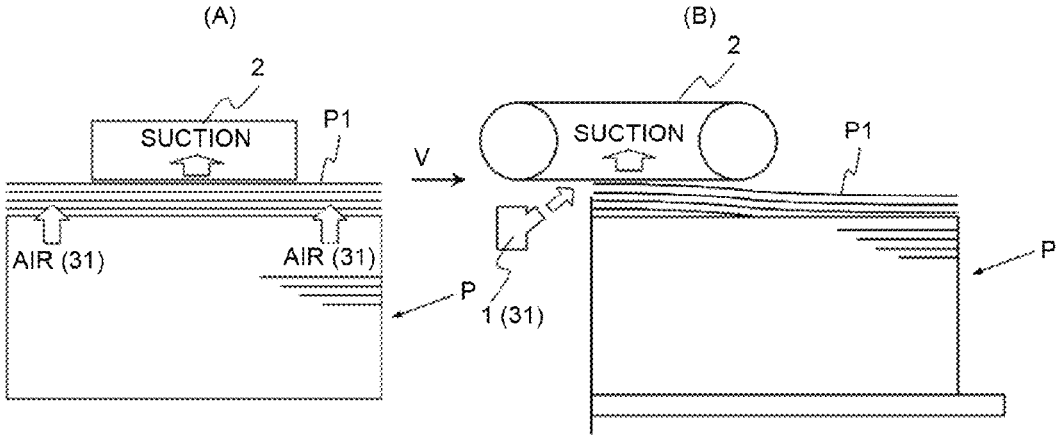
FIGS. 7(A) and 7(B) are diagrams illustrating a relationship between suction of a paper and air blowing from the blower.
Figure 8:
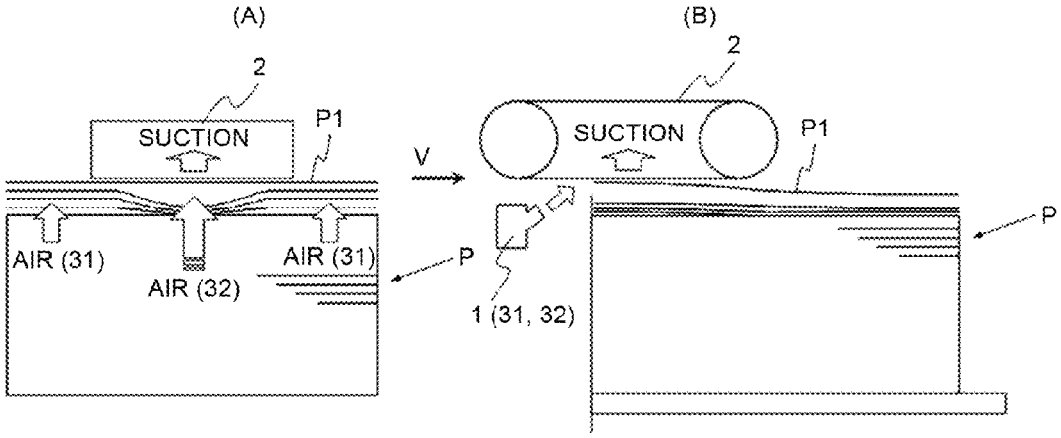
FIGS. 8(A) and 8(B) are diagrams illustrating another relationship between suction of a paper and air blowing from the blower.
Figure 9:
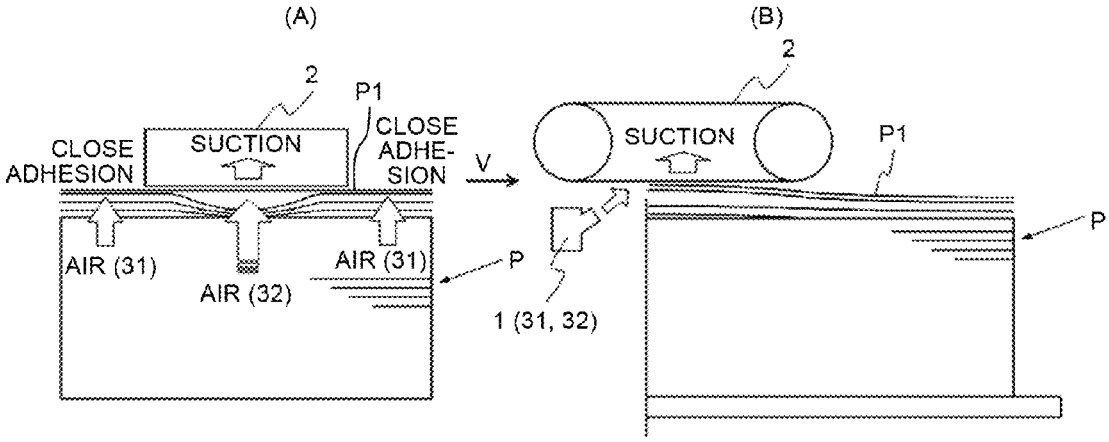
FIGS. 9(A) and 9(B) are diagrams illustrating still another relationship between suction of a paper and air blowing from the blower.
Figure 10:
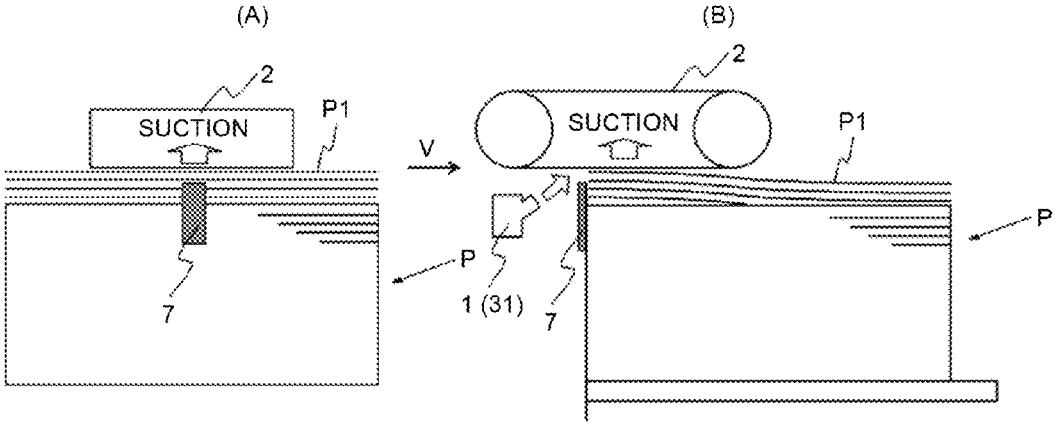
FIGS. 10(A) and 10(B) are diagrams illustrating a paper feeding device in which a paper damming up member is arranged at a front surface of a paper feeding tray.
Figure 11:
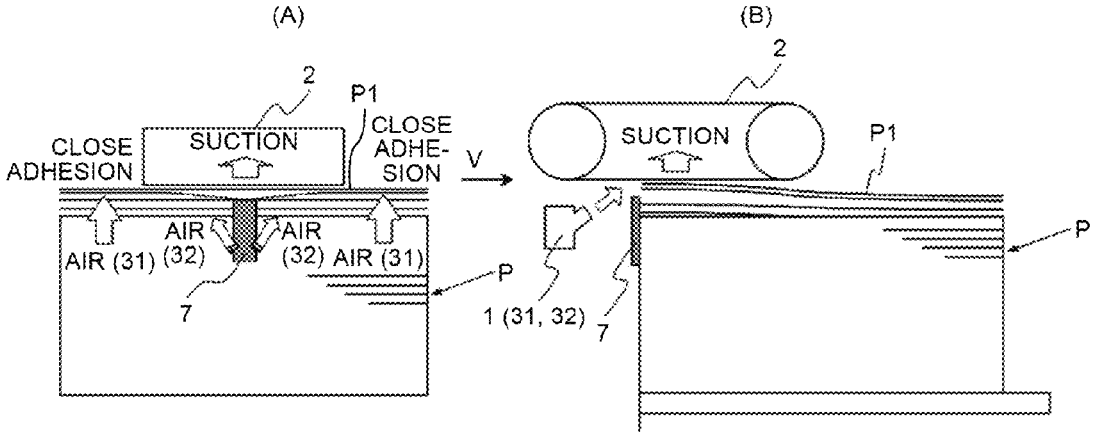
FIGS. 11(A) and 11(B) are diagrams illustrating a state in which the paper damming up member impedes a flow of the air through a separating nozzle in a configuration of FIGS. 10(A) and 10(B)
Figure 12:
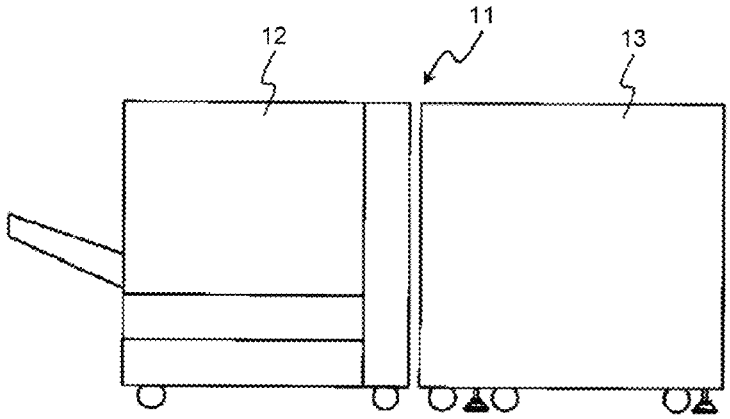
FIG. 12 is a conceptual diagram describing a configuration of an image forming apparatus provided with a paper feeding device according to an embodiment of the present invention.
Figure 13:
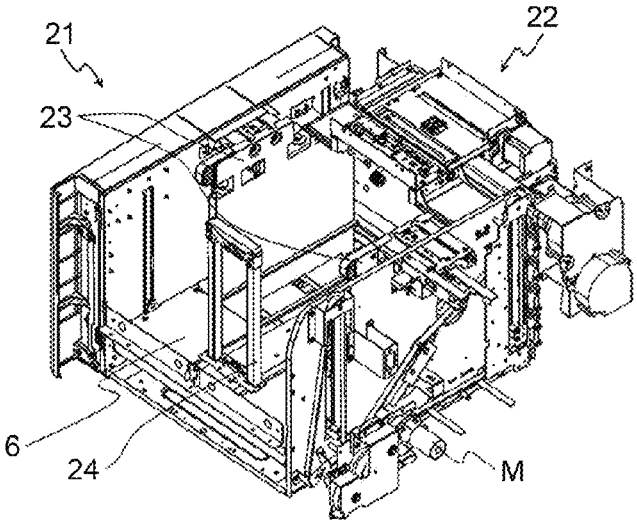
FIG. 13 is a perspective view illustrating an internal configuration of the paper feeding device.

FIG. 12 is a conceptual diagram describing a configuration of an image forming apparatus provided with a paper feeding device according to an embodiment of the present invention, and FIG. 13 is a perspective view illustrating an internal configuration of the paper feeding device. An image forming apparatus 11 illustrated in the drawing includes an image forming apparatus main body 12 and a paper feeding device 13 connected to one side surface of the image forming apparatus main body 12. The image forming apparatus main body 12 includes an image forming unit (not illustrated).

As illustrated in FIG. 13, the paper feeding device 13 includes a paper feeding tray (paper storage unit) 21 including a bottom plate 6 on which a paper bundle is stacked, and a suction belt unit (suction unit) 22 that takes out an uppermost paper P1 of the paper bundle one by one and feeds the paper toward a side of the image forming apparatus main body 12.

Note that configuration elements common to the conventional example, such as a blower that is an air blowing unit, are only denoted with the same reference signs in the drawings.

In the paper feeding tray 21, side fences 23 that guide side surfaces of the paper bundle loaded on the bottom plate 6 in a width direction (a direction perpendicular to the paper feeding direction) are provided at both sides, and an end fence 24 that presses the rear end surface of the paper bundle is provided at the rear of the paper bundle.

Figure 14:
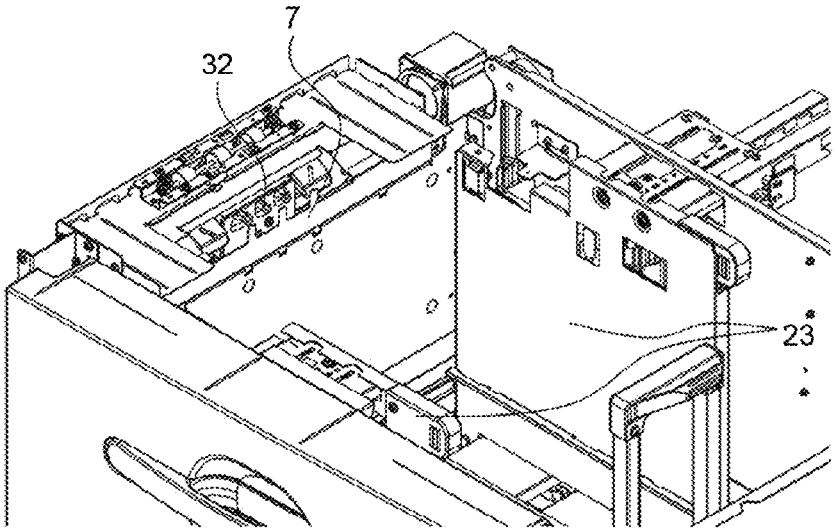
FIG. 14 is a diagram illustrating a state in which a suction belt unit is removed from the paper feeding device of FIG. 13.

FIG. 14 is a diagram in which the suction belt unit 22 is removed from the paper feeding device 13. As illustrated in the drawing, the blower 1 that floats and handles the papers is provided directly under the suction belt unit 22, and the paper damming up member 7 is integrally provided with a structure body of the paper feeding tray 21 at a front surface of the blower 1.

Figure 15:
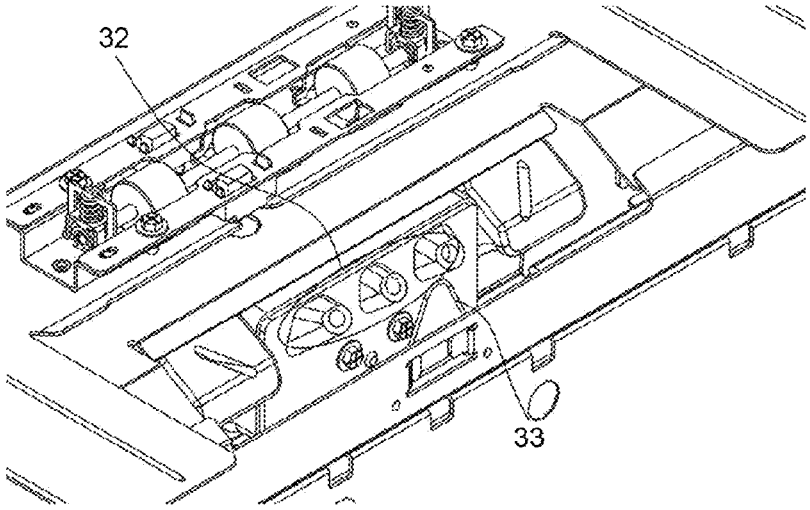
FIG. 15 is a diagram illustrating a default position of the paper damming up member by enlarging a principal part of FIG. 14.

FIG. 15 is a principal part enlarged diagram of FIG. 14, illustrating a default position of a paper damming up member 33 that is provided in order to prevent papers other than the uppermost paper of the paper bundle from being feeded from the paper feeding tray 21. As illustrated in the drawing, when the paper damming up member 33 is formed into an inverted-V shape, the separation air blowing through the separating nozzle 32 does not blow against the paper damming up member 33. The separation air smoothly arrives at the papers.

Figure 16:
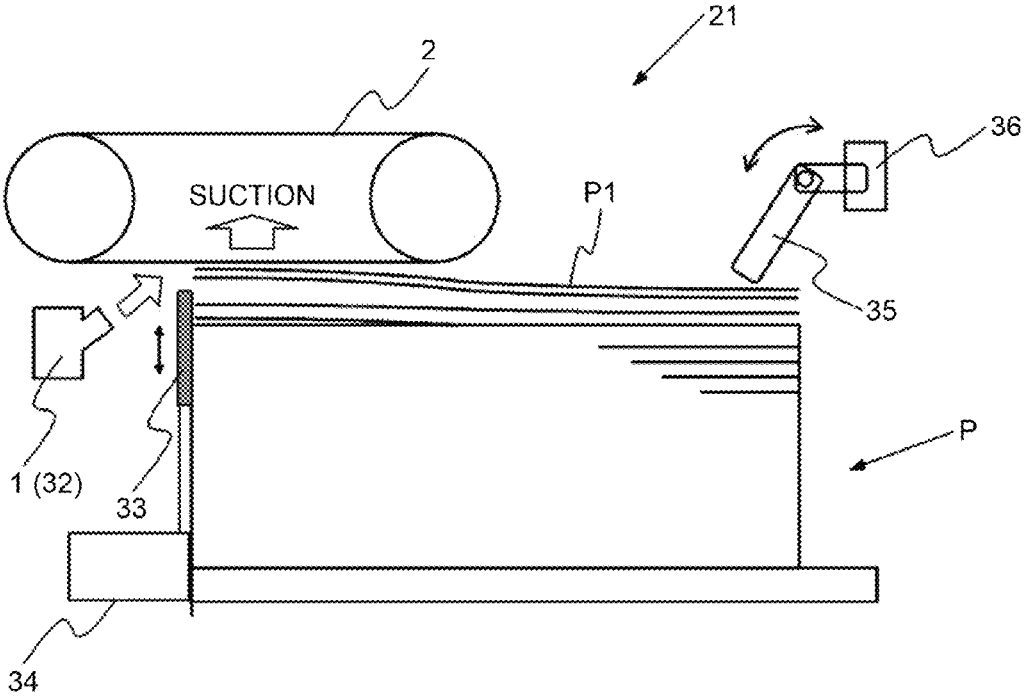
FIG. 16 is a diagram illustrating a positional relationship of the paper damming up member.

FIG. 16 is a diagram illustrating a positional relationship of the paper damming up member 33. The paper damming up member 33 has a configuration capable of changing upper and lower positions by an actuator 34, such as a motor and a solenoid. An uppermost paper surface position detection unit for detecting an upper surface position of the uppermost paper P1 includes an upper limit detection unit 35 and a sensor 36. The uppermost paper surface position detection unit comes in contact with an upper surface of the uppermost paper P1 by the upper limit detection unit 35, and detects a change of a contact state by the sensor 36. The upper limit detection unit 35 is swingably provided in the up and down direction, and comes in contact with the upper surface of the uppermost paper P1 and swings. The sensor 36 detects a swinging state, and detects the upper surface position of the uppermost paper P1. Then, the uppermost paper surface position detection unit lifts/lowers the paper damming up member 33 in the up and down direction in conjunction with the change of the detected position of the upper surface of the uppermost paper P1 by a control unit, such as a microcomputer (not illustrated), and variably controls the position of the paper damming up member 33, based on a detection result of the sensor 36. That is, the uppermost paper surface position detection unit controls the position of the bottom plate 6 of the paper feeding tray that is a lift unit such that the position of the upper surface of the uppermost paper P1 becomes a predetermined height position. Note that there are appropriate positions depending on the type or the size of the papers, the inclination of curling, or the like, and thus, the height of the paper in a damming up position registered for each paper in advance can be changed with the control configuration. This can also prevent the double feeding and non-paper feeding of the papers.

Figure 17:
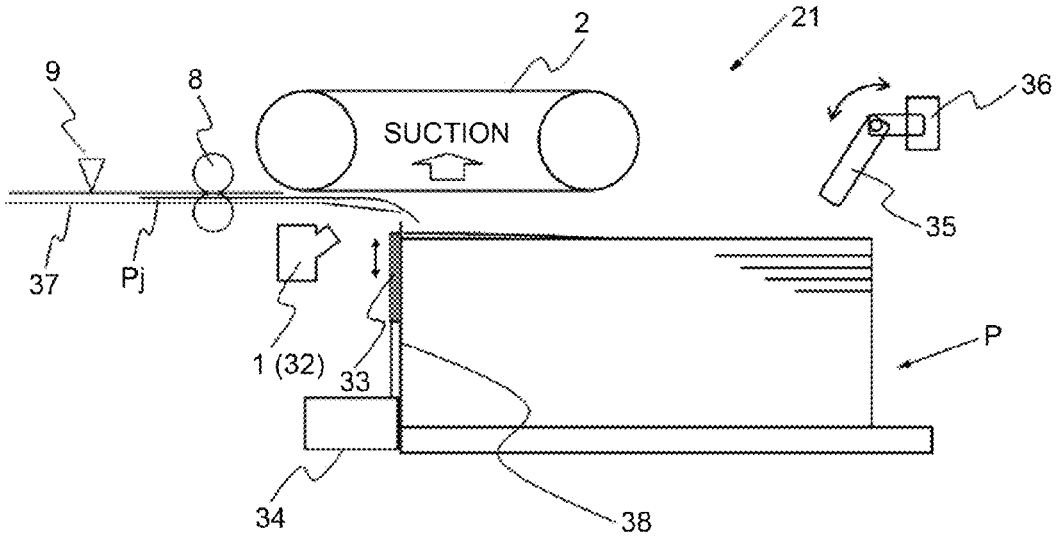
FIG. 17 is a diagram for describing paper jam processing.

Paper jam processing in the present embodiment will be described with reference to FIG. 17.

Assume a case in which a state of clogging a paper (paper jam) occurs due to some cause at timing when the paper arrives at a vicinity of the paper feeding sensor 9. Further, at this time, an operation of inverting the conveyance roller 8 and returning a jammed paper (hereinafter, a jammed paper) Pj in the paper feeding tray 21 is controlled. At this time, a state occurs, in which the paper damming up member 33 hinders the returning of the jammed paper Pj and the jammed paper Pj cannot be returned into the paper feeding tray 21.

Therefore, when the conveyance roller 8 is inversely rotated in returning the jammed paper Pj in the paper feeding tray 21, the position of the paper damming up member 33 is lowered by the actuator 34. The paper damming up member 33 is lowered to a position that is lower than a conveyance guide plate 37 at a downstream side in the paper conveying direction. Then, the jammed paper Pj is returned to the paper feeding tray 21 without damage. The returned jammed paper Pj can be reused. Note that the reference sign 37 in the drawing represents the conveyance guide plate that configures the guide unit. The conveyance guide plate is provided at a downstream side of a conveyance start position of a paper by the suction belt 2 in the paper conveying direction, and guides the conveyed paper from a lower surface side. The conveyance roller 8 is provided in the vicinity of the conveyance guide plate 37. Further, at least a rear end portion of the conveyance guide plate 37 in the paper conveying direction is arranged at an upper portion than an upper end of a tray abutting surface plate 38. Further, a rear end edge of the conveyance guide plate 37 is arranged, for example, to accord with the tray abutting surface plate 38 in the paper conveying direction, or is arranged to slightly get into the paper feeding tray 21. Then, as illustrated in FIG. 17, the jammed paper Pj can be returned to the paper feeding tray 21 without damage.

Further, the present invention is not limited to the above-described embodiments, and various modifications can be made by a person having an ordinary skill in the art within the technical idea of the present invention.

Patent Literature 1: Japanese Patent Application Laid-Open No. 2011-057379

Patent Literature 2: Japanese Patent Application Laid-Open No. 07-101575

According to the present invention, when paper jam processing of returning a clogged paper to a paper feeding tray is performed, a damming up member is lowered, so that there is an effect to return the paper to the paper feeding tray and to reuse the paper without causing damage to the paper.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A paper feeding device comprising:

a suction unit configured to suck an uppermost paper positioned at an uppermost position from among a paper bundle stacked on a paper feeding tray by air suction, and to convey the sucked paper;

a paper damming up member configured to dam up a paper other than the uppermost paper from being conveyed from the paper feeding tray;

a guide unit positioned at a downstream side of a conveyance start position of the uppermost paper by the suction unit in a paper conveying direction, and configured to serve as a guide when the uppermost paper conveyed by the suction unit is further conveyed toward the downstream side in the paper conveying direction;

an uppermost paper surface position detection unit configured to detect a height position of the uppermost paper in an up and down direction; and a control unit configured to lift/lower the paper feeding tray such that a height position of the uppermost paper in the tray becomes a predetermined position by a lift unit based on the position of the uppermost paper detected by the uppermost paper surface position detection unit, wherein a height position of the paper damming up member is variable in a height direction of the paper bundle loaded in the paper feeding tray, at least a rear end portion of the guide unit in the paper conveying direction is arranged at an upper portion than an upper end of the paper damming up member, and the control unit variably controls the height position of the paper damming up member according to a result of detection by the uppermost paper surface position detection unit, and controls the paper damming up member to lower when a paper conveyed from the paper feeding tray is clogged and is once returned to the paper feeding tray.

2. The paper feeding device according to claim 1, wherein the control unit includes a conveyance roller for conveying a paper in a vicinity of the guide unit, and when performing an operation of returning a jammed paper by inverse of the conveyance roller in a state where a rear end of a clogged paper in the paper conveying direction, the clogged paper having been conveyed from the paper feeding tray, is passing through the paper damming up member, the control unit controls the paper damming up member to lower.

3. The paper feeding device according to claim 1, wherein the control unit controls a position of the paper damming up member in the up and down direction according to a type, a size, curling of a paper loaded on the paper feeding tray.

4. The paper feeding device according to claim 1, further comprising an air blowing unit configured to float end surfaces of the uppermost paper and papers in a vicinity of the uppermost paper, and mutually separate the papers in the vicinity of the uppermost paper among papers that make the paper bundle by blowing air against a position in a vicinity of the uppermost paper of the paper bundle loaded on the paper feeding tray and an end portion of the paper bundle at a downstream side in the paper conveying direction, wherein the paper damming up member is arranged between the air blowing unit and an end portion of the paper feeding tray at a downstream side in the paper conveying direction.

5. The paper feeding device according to claim 1, wherein the uppermost paper surface position detection unit includes an actuator that comes in contact with the uppermost paper and swings upward and downward according to the height of the uppermost paper, and a sensor configured to detect upper and lower positions of the actuator.

6. An image forming apparatus comprising a paper feeding device for feeding a paper to an image forming unit, wherein the paper feeding device comprises:

a suction unit configured to suck an uppermost paper positioned at an uppermost position from among a paper bundle stacked on a paper feeding tray by air suction, and to convey the sucked paper;

a paper damming up member configured to dam up a paper other than the uppermost paper from being conveyed from the paper feeding tray;

a guide unit positioned at a downstream side of a conveyance start position of the uppermost paper by the suction unit in a paper conveying direction, and configured to serve as a guide when the uppermost paper conveyed by the suction unit is further conveyed toward the downstream side in the paper conveying direction;

an uppermost paper surface position detection unit configured to detect a height position of the uppermost paper in an up and down direction; and a control unit configured to lift/lower the paper feeding tray such that a height position of the uppermost paper in the tray becomes a predetermined position by a lift unit based on the position of the uppermost paper detected by the uppermost paper surface position detection unit, wherein a height position of the paper damming up member is variable in a height direction of the paper bundle loaded in the paper feeding tray, at least a rear end portion of the guide unit in the paper conveying direction is arranged at an upper portion than an upper end of the paper damming up member, and the control unit variably controls the height position of the paper damming up member according to a result of detection by the uppermost paper surface position detection unit, and controls the paper damming up member to lower when a paper conveyed from the paper feeding tray is clogged and is once returned to the paper feeding tray.

* * * * *